US006463993B1

(12) United States Patent
Cle Nogueras et al.

(10) Patent No.: US 6,463,993 B1
(45) Date of Patent: Oct. 15, 2002

(54) MOLDING CHAMBER FOR GREEN SAND MOLDS

(75) Inventors: Miguel Cle Nogueras; Ignacio Goya Arcelus, both of Vitoria (ES)

(73) Assignee: Loramendi, S.A., Vitoria (ES)

( * ) Notice: Subject to any disclaimer, the term of this patent is extended or adjusted under 35 U.S.C. 154(b) by 0 days.

(21) Appl. No.: 09/857,014

(22) PCT Filed: Oct. 8, 1999

(86) PCT No.: PCT/ES99/00320

§ 371 (c)(1),
(2), (4) Date: May 30, 2001

(87) PCT Pub. No.: WO01/26844

PCT Pub. Date: Apr. 19, 2001

(51) Int. Cl.[7] ..... B22C 9/20; B22C 21/02

(52) U.S. Cl. ..... 164/322; 164/195; 164/377; 164/237

(58) Field of Search ..... 164/322, 129, 164/130, 195, 377, 378, 237

(56) References Cited

U.S. PATENT DOCUMENTS

| | | | | |
|---|---|---|---|---|
| 3,744,550 | * | 7/1973 | Larkin | 164/172 |
| 3,749,151 | * | 7/1973 | George et al. | 164/322 |
| 3,773,100 | | 11/1973 | Mawson et al. | 164/237 |
| 5,095,967 | * | 3/1992 | Nagarwalla et al. | 164/186 |
| 5,246,058 | * | 9/1993 | Murata | 164/182 |
| 5,332,025 | | 7/1994 | Larsen | 164/456 |
| 5,355,929 | * | 10/1994 | Sorensen | 164/20 |
| 5,547,015 | * | 8/1996 | Johansen | 164/456 |
| 5,735,334 | * | 4/1998 | Sutton et al. | 164/130 |

FOREIGN PATENT DOCUMENTS

| | | |
|---|---|---|
| EP | 0072254 | 2/1983 |
| EP | 0488842 | 6/1992 |
| ES | 2091399 | 11/1996 |
| FR | 2196865 | 3/1974 |
| GB | 1529736 | 10/1978 |

* cited by examiner

*Primary Examiner*—M. Alexandra Elve
*Assistant Examiner*—Len Tran
(74) *Attorney, Agent, or Firm*—Ladas & Parry

(57) ABSTRACT

A tubular sand molding chamber having two conventional movable walls one mounted on a piston for compacting and expelling the cake and the other pivotably mounted on a displaceable hinge arm for opening the chamber, but having side walls that are also movable is disclosed. Each movable side wall includes a plate (11) mounted on a respective plate-holder (12) that is connected to guides (13) for sliding the side wall on a fixed support (14) through the action of a respective hydraulic cylinder (15), in such a manner that the effective width of the chamber be adapted to different cake sizes, in order to minimize the consumption of sand. However, the movable end wall that are mounted on a faceplate (20) affixed to a hydraulic cylinder and pivotably mounted on the hinge arm, respectively, for the compacting and expelling the sand cake, have replaceable plate assemblies. Respective replaceable plate assemblies include pattern plates having respective individual plate-holder frames, so that the replaceable plate assemblies selectably provide different widths, and the replaceable plate assemblies are attached to a faceplate (20) having a fixed width equal to or less than the minimum usable width of the chamber.

5 Claims, 3 Drawing Sheets

MOLDING CHAMBER FOR GREEN SAND MOLDS

BACKGROUND OF THE INVENTION

1. Field of the Invention

The present invention relates to a molding chamber for green sand cakes. More particularly, the present invention is directed to a variable-volume molding chamber that reduces the consumption of sand used in making the cake, by minimizing dimensions of the molding chamber used in making the cake.

2. Discussion of Related Art

In conventional sand cake molding machines used for casting, a tubular chamber is formed that has a generally rectangular in cross section. The chamber is closed at one end by a movable, wall, one that is pivotably mounted to permit the egress of the cake once the cake is molded. At the other end it is closed by an end wall that is moved by a piston for implementing compacting and subsequent expulsion of the cake. Thus, the conventional sand molding chamber has four fixed walls constituting the tubular body, including an upper one having a mouth or orifice through which the sand enters, and two movable end walls, corresponding to the six faces formed on the cake by the sand molding chamber, More specifically, as is illustrated in the different molding steps shown in FIG. 1, the sand cavity is formed when the two movable walls are separated by a suitable distance (first step), the movable walls then move towards each other for compacting the sand cake (second step), the pivotable movable wall subsequently is displaced outwards longitudinally and then tilted upwards to permit the cake to pass freely out of the sand molding chamber (third step), following which the movable wall displaced by the piston moves until it comes into contact with that pivotable wall (fourth step), the piston returns to its initial position while the filling of the mold provided by the sand takes place (fifth step), and finally the pivotable wall descends and is displaced longitudinally until, in the (sixth step), it is in the position shown in the first step, and the sand molding process begins once more.

Thus, given that both the upper and lower walls, and the side walls of the conventional sand molding chamber are fixed, although the smaller castings that are made using the sand molding chamber would theoretically permit the use of smaller sand cakes that use less sand, this is not possible. The entire sand molding chamber that is used for making larger castings must be filled with sand, regardless. This unnecessary use of larger sand cakes is costly. For example:

1) Because the amount of sand that is available in the factory is a finite number of tons the amount of sand available is a fixed constraint on the feasible production rate of the casting machine. That is, in accordance with the invention, the sand molding chamber of the casting machine may be capable of producing more cakes than was possible for machines having conventional mold-making chambers, given the finite quantity of sand available in the casting shop.
2) After the casting process the sand mold is destroyed and the sand has to be treated to remove impurities. That processing incurs costs and times that increase as the amount of sand being processed increases.

The invention provides green sand cake molding chambers that overcome the aforementioned problems in an entirely satisfactory manner.

SUMMARY OF THE INVENTION

In accordance with the invention a molding chamber having a variable volume is provided, permitting the volume of sand being used to adjust to the individual dimensional requirements of each type of cake being formed, particularly by reducing to a theoretical minimum requirement the actual maximum dimensions used in the sand molding chamber. Specifically, walls of the chamber that are fixed in place in conventional sand molding chambers, are formed of respective movable plates, is movable plate is mounted on a plate-holder fame, and the plate-holder frames are moved by the push rods of respective hydraulic cylinders. Guides cooperating with the plate-holder frames are conveniently mounted on a support so as to ensure correct displacement of the plates in their closing and opening movements.

The two movable end walls each have replaceable plate assemblies. Each replaceable plate assembly includes a pattern plate having a width that varies depending upon the width of the sand cake required by the pattern. The width of the sand cake is variable between a maximum measurement and a minimum measurement, the maximum measurement corresponding to the greatest width the mold-making chamber of the casting machine can produce and a minimum measurement being limited by the width of a faceplate on which the plate-holder frame is mounted. A pattern plate is fastened to each plate-holder frame, preferably by screws, and the plate-holder frame is fastened, preferably by means of pneumatic clamps, to each faceplate, one faceplate being fixed to the pneumatic compacting cylinder and the other faceplate being pivotably mounted to a displaceable hinge arm that permits the mold-making chamber to open.

BRIEF DESCRIPTION OF THE DRAWINGS

The features and advantages of the invention will be better understood when the description of presently preferred embodiments provided below is considered in conjunction with the drawings provided, wherein.

DETAILED DESCRIPTION OF PREFERRED EMBODIMENTS

Figure 1:
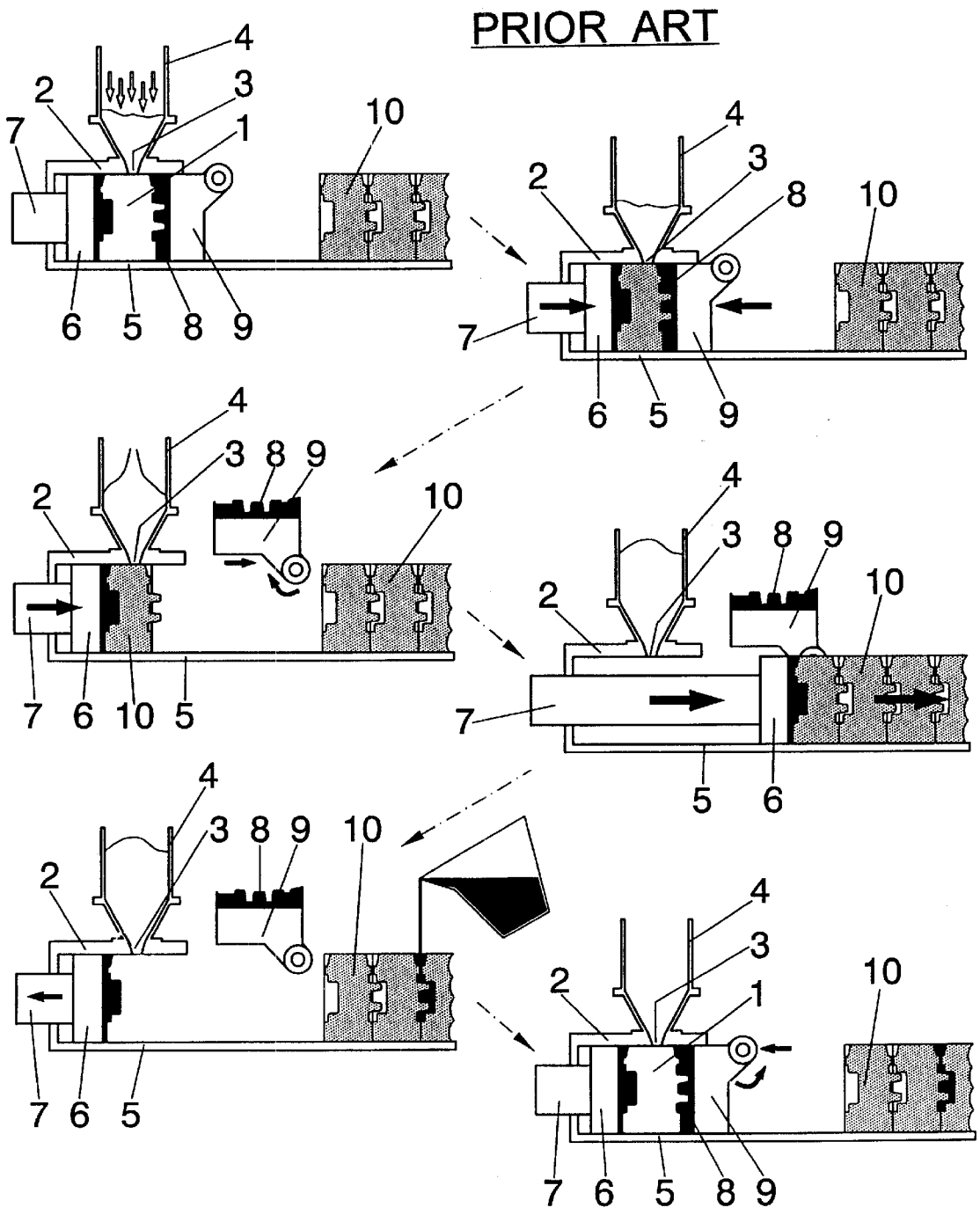
FIG. 1 is a schematic diagram showing the six steps of a green sand cake molding process provided using a conventional sand molding chamber.
Figure 2:
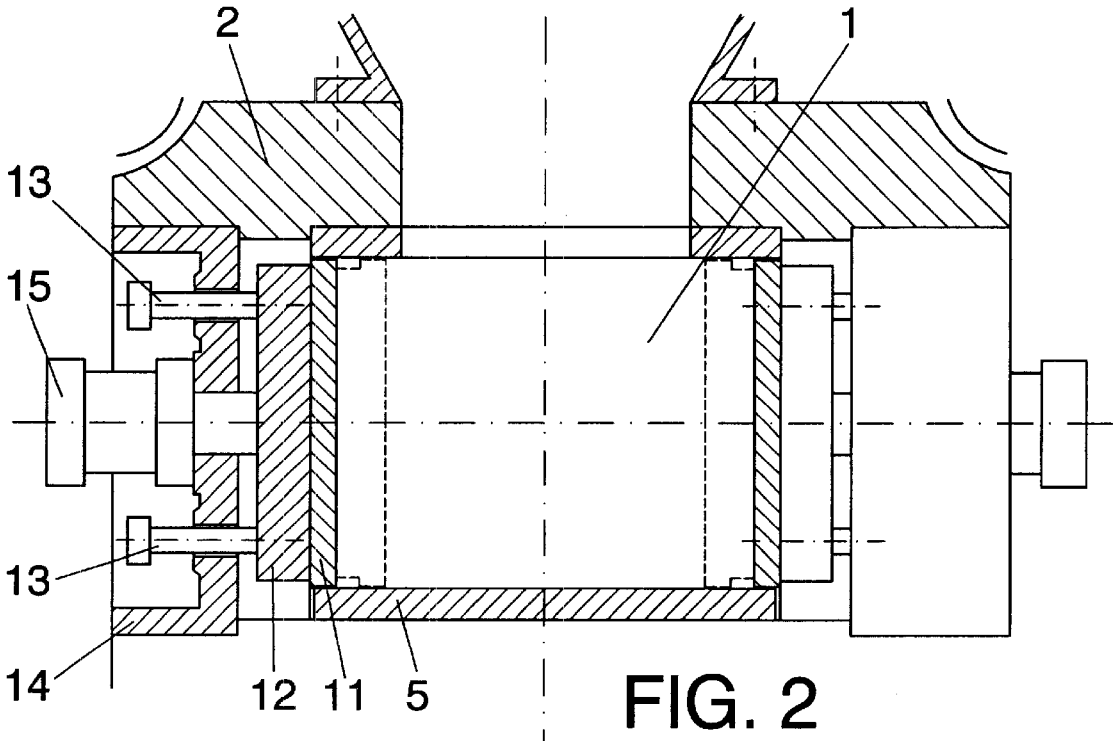
FIG. 2 is a schematic transverse cross section of a mold-making chamber in accordance with the invention.

Like the conventional mold-making chamber (1) shown in FIG. 1, the sand molding chamber in FIG. 2 has an upper wall (2) including a mouth (3) for receiving sand from a suitable hopper (4), a lower wall (5), two fixed side walls not visible in FIG. 1 and two movable end walls, one wall (6) associated with the relative compacting and expulsion piston, and one end wall (8) pivotably mounted on a hinge arm (9) and also longitudinally displaceable, so that this end wall (8) is capable of being separated from the other end wall (6) and then pivoted upward, as can be seen in the third step, to permit expulsion of the cake (10) by the other end wall. However, in the sand molding chamber shown in FIG.

2, the two fixed side walls that were not shown in FIG. 1, can also be moved so that they vary the volume of the chamber (1), to suit the requirements of each type of cake (10) that is molded in the chamber.

Preferably, each of these side walls has a plate (11), which is mounted on a plate-holder frame (12). The plate-holder frames are joined to guides (13) which permit transverse displacement of the side walls from a respective fixed support (14) when they are operated by a respective hydraulic cylinder (15), so that the plates (11) move to the position of maximum separation shown by the solid line in FIG. 2 or any position between that position and the position of maximum proximity that shown by dashed lines in the same figure. These two limiting positions are also schematically indicated in plan view in FIGS. 3 and 4 by indicating a corresponding displacement of the push rod of the piston (7) toward its position of maximum proximity.

Figure 3:
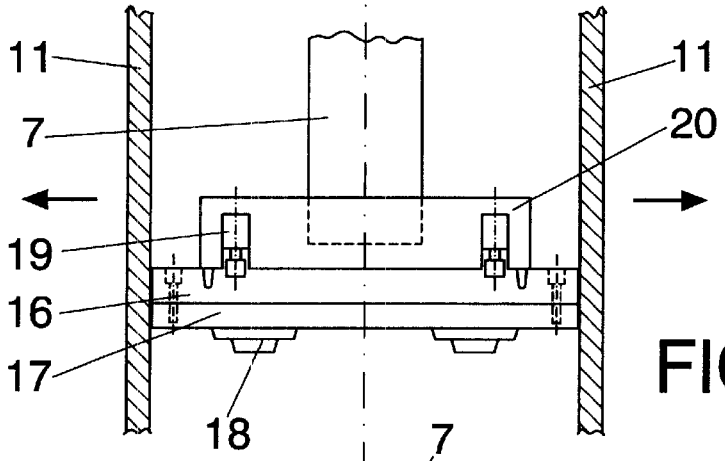
FIG. 3 is a schematic plan view of a detail of the chamber shown in FIG. 2, arranged for producing sand cakes of maximum size.
Figure 4:
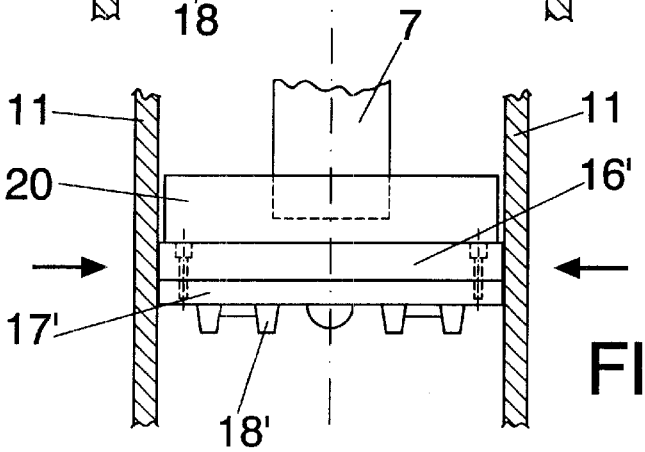
FIG. 4 is a schematic plan view of the detail of the chamber shown in FIG. 3, but arranged for producing sand cakes of minimum size.

Between the side wall plates (11), are replaceable plate assemblies (not shown in FIG. 2). Each replaceable plate assembly is adapted to slide between the side wall plates (11) and includes a plate-holder frame (16) that is fastened by screws, as is the conventional practice, to a plate (17) having a suitable molding pattern, such as either of the patterns (18–18') shown in FIGS. 4 and 57 and this replaceable plate assembly is fastened, in turn to a plate (20), preferably by means of hydraulic clamps (19). The plate (20) is affixed to the push rod of the hydraulic cylinder (7). Thus, different frames (16) corresponding to pattern plates of different sizes (17–17') that are suited to different patterns (18–18') can be used with the same base plate (20), as is illustrated in FIGS. 3 and 4. A similar replaceable pattern plate structure is also provided for the movable end wall of the sand molding chamber that pivots on the hinge arm (9).

Figure 5:
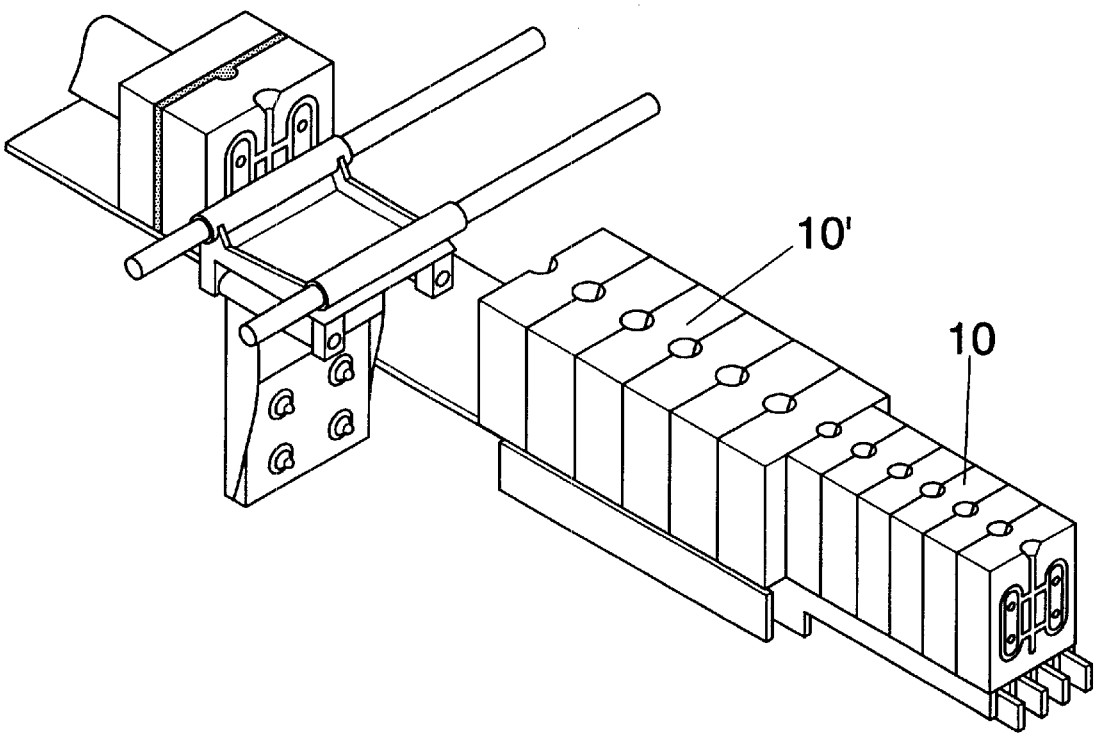
FIG. 5 is a schematic perspective view of a row of cakes suitable for making identical castings, half of them showing the size of the sand molds produced by a conventional green sand molding machine and the other half showing the smaller size produced in accordance with the invention.

As is shown in FIG. 5, the cakes (10) that are used to make the particular casting shown therein can have considerably smaller dimensions and therefore these smaller cakes (10) require a much smaller quantity of sand than the large cakes (10') produced by a conventional sand molding chamber that makes sand cakes that are all the same size. For example, the size of the large sand cake (10') that is conventionally used for that small casting pattern that is shown in the smaller sand cake (10), also accommodates the much larger casting pattern shown in the large unnumbered sand cake located in the upper left-hand part of FIG. 5.

Molding chambers constructed and operated in accordance with the invention not only permit a dramatic reduction in the consumption of sand in making the cakes, but also offer the possibility of employing tools of different patterns and machines of smaller size, flexibility in designing new tools, new options for the design of the patterns that are cast, and improved efficiency in casting despite the constraints usually imposed by a limited sand storage capacity.

What is claimed is:

1. A tubular molding chamber having an orifice communicating with a sand feed hopper, a movable first end wall connected to a push rod, said wall and said push rod being adapted to push a sand cake out of the molding chamber, and a movable second end wall adapted to open the chamber so as to permit the sand cake to be pushed out of the molding chamber, said molding chamber comprising:

a movable side wall assembly, said movable side wall assembly including a plate holder and a guide connected to said plate holder; and a fixed support, said guide being adapted for sliding along said fixed support so that said movable side wall assembly is displaceable along said fixed support to vary the width of the molding chamber.

2. The tubular molding chamber of claim 1, said molding chamber further comprising:

a first replaceable plate assembly, said replaceable plate assembly having a variable width and adapted to be attached to said movable first end wall, said movable first end wall including a faceplate connected to the push rod and adapted to be attached to said replaceable plate assembly, said faceplate having a width that is not greater than the minimum width of the chamber; and a second replaceable plate assembly, said second replaceable plate assembly having a variable width and adapted to be attached to said movable second end wall.

3. The tubular molding chamber of claim 2 wherein the replaceable plate assemblies include pattern plates.

4. The tubular molding chamber of claim 2 wherein a respective replaceable plate assembly is coupled to a respective movable end wall by pneumatic clamps.

5. The tubular molding chamber of claim 2 wherein a respective replaceable plate assembly is coupled to a respective movable end wall by hydraulic clamps.

* * * * *